US006721965B1

(12) United States Patent
Alston

(10) Patent No.: US 6,721,965 B1
(45) Date of Patent: Apr. 20, 2004

(54) TOILET BOWL SCREEN

(76) Inventor: Richard C. Alston, 6605 Monte Vista Pl., Tampa, FL (US) 33634

( * ) Notice: Subject to any disclaimer, the term of this patent is extended or adjusted under 35 U.S.C. 154(b) by 0 days.

(21) Appl. No.: 10/317,377

(22) Filed: Dec. 11, 2002

(51) Int. Cl.[7] ..... E03D 11/00; E03D 9/00
(52) U.S. Cl. ..... 4/256.1
(58) Field of Search ..... 4/256.1; 210/464, 210/465

(56) References Cited

U.S. PATENT DOCUMENTS 939,013 A * 11/1909 Haddock ..... 4/256.1
1,063,247 A * 6/1913 Ebert ..... 4/256.1
2,617,996 A * 11/1952 Hoffman et al. ..... 4/256.1
2,974,324 A * 3/1961 Lundelius ..... 4/256.1
4,040,964 A * 8/1977 Hegyi ..... 210/244
5,573,292 A * 11/1996 Citino ..... 294/7
6,568,314 B1 * 5/2003 Stepanova ..... 210/464

* cited by examiner

*Primary Examiner*—Tuan N. Nguyen

(57) ABSTRACT

A toilet bowl screen is provided for use in connection with a typical toilet bowl. The toilet bowl screen comprises a razor wire screen, a circular plastic ring connected to the perimeter of the razor wire screen, and a plastic handle connected to the plastic ring, wherein the top part of the handle is configured to rest on the rear upper surface of the toilet bowl, thereby allowing quick and easy removal of the toilet bowl screen. The toilet bowl screen has particular utility in connection with trapping large items while cutting through waste and toilet paper with razor wire.

20 Claims, 2 Drawing Sheets

TOILET BOWL SCREEN

BACKGROUND OF THE INVENTION

1. Field of the Invention

The present invention relates to a toilet bowl screen for use in connection with a typical toilet bowl. The toilet bowl screen has particular utility in connection with trapping large items while cutting through waste and toilet paper with razor wire.

2. Description of the Prior Art

Toilet bowl screens are desirable for keeping large items from being flushed down toilets and becoming trapped in pipes, necessitating plumbing work.

The use of toilet bowl screens is known in the prior art. For example, U.S. Pat. No. 2,974,324 to Lundelius discloses a strainer unit for toilets. However, the Lundelius '324 patent does not provide an apparatus with razor wire to cut through waste and toilet paper that is undesirable to remove from toilets.

U.S. Pat. No. 2,785,561 to Hoffman et al. discloses a toilet bowl screen. However, the Hoffman '561 patent does not provide an apparatus with razor wire to cut through waste and toilet paper that is undesirable to remove from a toilet.

Similarly, U.S. Pat. No. 2,617,996 to Hoffman et al. discloses a guard for toilet bowls. However, the Hoffman '996 patent does not provide an apparatus with razor wire to cut through waste and toilet paper that is undesirable to remove from toilet bowls.

U.S. Pat. No. 1,063,247 to Ebert discloses a strainer for closet bowls. However, the Ebert '247 patent does not provide an apparatus with razor wire to cut through waste and toilet paper that users do not wish to remove from the bowls.

U.S. Pat. No. 594,169 to Catsiff discloses a basket trap for water closets. However, the Catsiff '169 patent does not provide an apparatus with razor wire to cut through waste and toilet paper that users do not wish to remove, and cannot prevent items from being trapped within pipes.

U.S. Pat. No. 939,013 to Haddock discloses a cuspidor. However, the Haddock '013 patent does not provide a screen suitable for use in a toilet.

Lastly, U.S. Pat. No. Des. 259,225 to Scheer discloses a urinal deflector. However, the Scheer '225 patent does not provide a screen suitable for use in a toilet.

While the above-described devices fulfill their respective, particular objectives and requirements, the aforementioned patents do not describe a toilet bowl screen that allows large items to be trapped while cutting through waste and toilet paper with razor wire. The prior art patents make no provision for cutting through waste and toilet paper that is undesirable to remove from toilet bowls.

Therefore, a need exists for a new and improved toilet bowl screen that can be used for trapping large items while cutting through waste and toilet paper with razor wire. In this regard, the present invention substantially fulfills this need. In this respect, the toilet bowl screen according to the present invention substantially departs from the conventional concepts and designs of the prior art, and in doing so provides an apparatus primarily developed for the purpose of trapping large items while cutting through waste and toilet paper with razor wire.

SUMMARY OF THE INVENTION

In view of the foregoing disadvantages inherent in the known types of toilet bowl screens now present in the prior art, the present invention provides an improved toilet bowl screen, and overcomes the above-mentioned disadvantages and drawbacks of the prior art. As such, the general purpose of the present invention, which will be described subsequently in greater detail, is to provide a new and improved toilet bowl screen which has all the advantages of the prior art mentioned heretofore and many novel features that result in a toilet bowl screen which is not anticipated, rendered obvious, suggested, or even implied by the prior art, either alone or in any combination thereof.

To attain this, the present invention essentially comprises a toilet bowl screen, comprising a razor wire screen, a ring connected to the perimeter of the razor wire screen, and a handle connected to the ring.

In one embodiment, the present invention comprises a toilet bowl screen, comprising a razor wire screen, a circular ring connected to the perimeter of the razor wire screen, and a handle connected to the ring.

In another embodiment, the present invention comprises a toilet bowl screen for trapping large items while cutting through waste and toilet paper, comprising a razor wire screen, a circular plastic ring connected to the perimeter of the razor wire screen, and a plastic handle connected to the plastic ring, wherein the top part of the handle is configured to rest on the rear upper surface of the toilet bowl, thereby allowing quick and easy removal of the toilet bowl screen.

There has thus been outlined, rather broadly, the more important features of the invention in order that the detailed description thereof that follows may be better understood and in order that the present contribution to the art may be better appreciated.

The invention may also include clips, hooks, and other attachments. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet bowl screen that has all of the advantages of the prior art toilet bowl screens and none of the disadvantages.

It is another object of the present invention to provide a new and improved toilet bowl screen that may be easily and efficiently manufactured and marketed.

An even further object of the present invention is to provide a new and improved toilet bowl screen that has a low cost of manufacture with regard to both materials and labor, and which accordingly is then susceptible of low prices of sale to the consuming public, thereby making such toilet bowl screen economically available to the buying public.

Still another object of the present invention is to provide a new toilet bowl screen that provides in the apparatuses and methods of the prior art some of the advantages thereof, while simultaneously overcoming some of the disadvantages normally associated therewith.

Even still another object of the present invention is to provide a toilet bowl screen for trapping large items. This allows the items to be removed, and prevents the items from being flushed down the toilet and becoming trapped in pipes, necessitating plumbing work and removal of the toilet.

Still yet another object of the present invention is to provide a toilet bowl screen for cutting through waste and toilet paper with razor wire. This prevents the waste and toilet paper from becoming caught on the screen and clogging it, and makes it possible to flush this material that is undesirable to remove from the toilet bowl.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENTS

Figure 1:
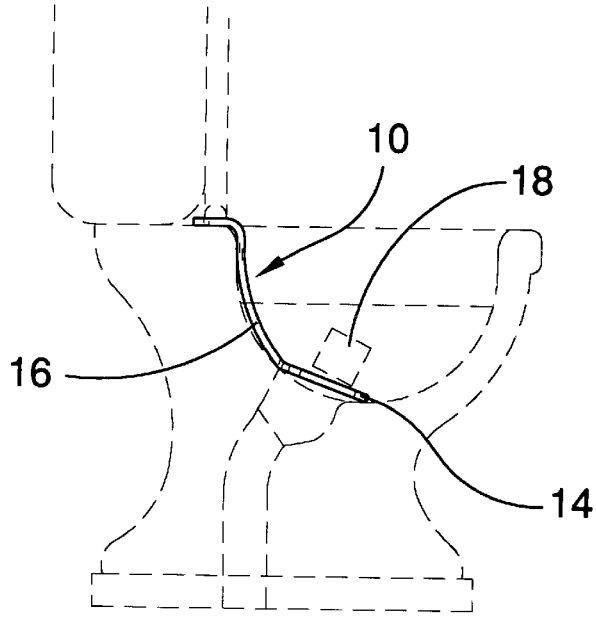
FIG. 1 is a left elevational view of the preferred embodiment of the toilet bowl screen constructed in accordance with the principles of the present invention.
Figure 2:
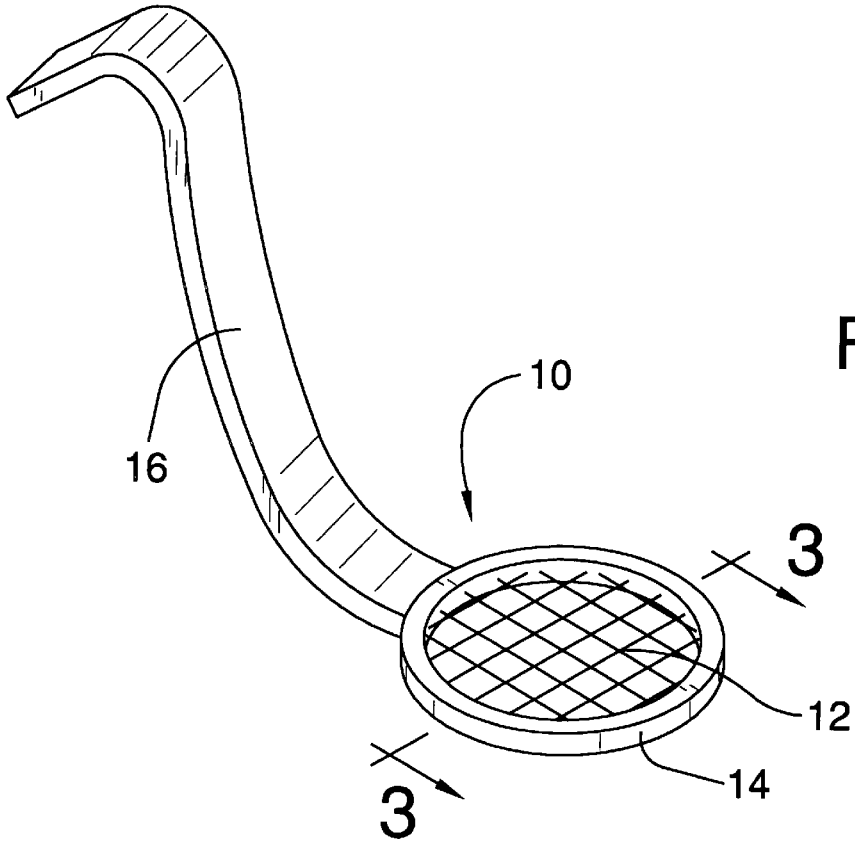
FIG. 2 is an isometric perspective view of the toilet bowl screen of the present invention.
Figure 3:
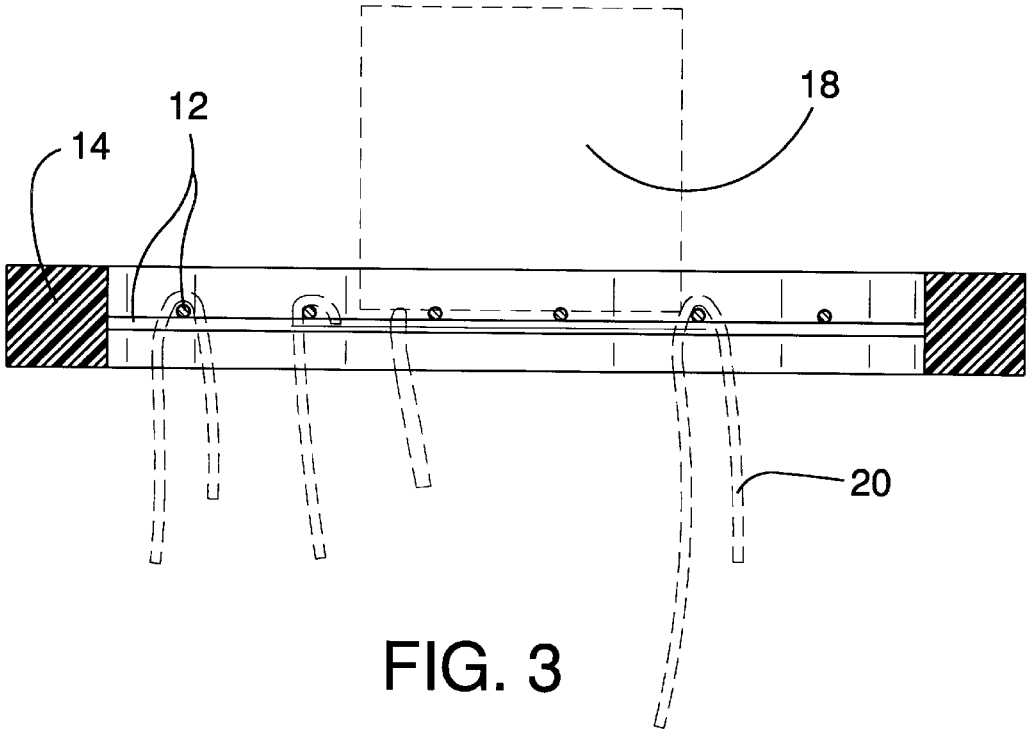
FIG. 3 is a rear elevational cross-sectional view of the toilet bowl screen of the present invention illustrated in FIG. 2 and taken along the line 3—3.

Referring now to the drawings, and particularly to FIGS. 1–3, a preferred embodiment of the toilet bowl screen of the present invention is shown and generally designated by the reference numeral 10.

In FIG. 1, a new and improved toilet bowl screen 10 of the present invention for trapping large items 18 while cutting through waste and toilet paper with razor wire is illustrated and will be described. More particularly, the toilet bowl screen 10 comprises a circular ring 14 connected to the perimeter of a razor wire screen, and a handle 16 connected to the ring 14, wherein the top part of the handle 16 is configured to rest on the rear upper surface of the toilet bowl, thereby allowing quick and easy removal of the toilet bowl screen 10.

FIG. 2 is an isometric perspective view of the toilet bowl screen 10 of the present invention, and illustrates a razor wire screen 12, a circular ring 14 connected to the perimeter of the razor wire screen 12, and a handle 16 connected to the ring 14, wherein the top part of the handle 16 is configured to rest on the rear upper surface of the toilet bowl, thereby allowing quick and easy removal of the toilet bowl screen 10.

FIG. 3 is a rear elevational cross-sectional view of the toilet bowl screen of the present invention, and illustrates the razor wire screen 12, and the circular ring 14 connected to the perimeter of the razor wire screen 12, wherein the razor wire screen traps large items 18 while cutting through waste and toilet paper debris 20.

The toilet bowl screen of the present invention is a special insert for any standard household toilet, which prevents objects from becoming lodged in the lower part of the bowl, in turn requiring the removal of the bowl or use of a plumbing snake. The main part of the screen consists of a section of wire-mesh screening having very sharp edges and a relatively large grid spacing, much larger than that of a screen door. In one embodiment, this razor wire screening is held in place via a plastic ring that is attached to a plastic handle. The top part of the handle rests on the top of the toilet bowl, at the back of the bowl, thereby allowing quick and easy removal of the entire screen when necessary. The handle is configured to conform to the wall of the toilet bowl to prevent items from snagging on the handle during flushing.

The toilet bowl screen of the present invention fulfills the need for a very easy method for preventing objects from becoming lodged in the lower part of a toilet bowl or in the pipes below the toilet. The appealing features of the toilet bowl screen of the present invention include its convenience, ease of installation and use, time-saving nature, optimum size, reasonable price, and its ability to prevent objects from becoming lodged in such a manner that the bowl has to be removed. Homeowners, especially those with young children, will find this small assembly quite helpful.

The toilet bowl screen of the present invention is produced easily using conventional and readily available materials and manufacturing processes. The handle and ring can be molded from a plastic material using a process such as injection molding. Suitable plastics include poly(vinyl chloride) (PVC), polystyrene (PS), polypropylene (PP), a polyethylene (PE) such as high density polyethylene (HDPE), an acrylonitrile-butadiene-styrene (ABS) resin, a styreneacrylonitrile (SAN) resin, polycarbonate (PC), a polyester such as polyethylene terephthalate (PET) or polybutylene terephthalate (PBT), or blends thereof, as well as any other suitable plastic material known to those skilled in the art. The razor wire comprises a metal material, preferably stainless steel or any other suitable metal alloy that is resistant to rusting. The razor wire may also comprise a metal that has been coated, galvanized, anodized, or otherwise treated to prevent rusting.

In one embodiment, the toilet bowl screen of the present invention comprises a toilet bowl clip having a support member extending downwardly therefrom, for supporting a hoop shaped frame including a series of criss crossing razor wire elements disposed therebetween.

In use, it can now be understood that the toilet bowl screen of the present invention traps large items, allowing them to be removed and preventing them from being flushed down the toilet and becoming trapped in pipes, necessitating plumbing work and removal of the toilet. The toilet bowl screen of the present invention also cuts through waste and toilet paper debris with razor wire, preventing the waste and toilet paper from becoming caught on the screen and clogging it, and making it possible to flush this material that is undesirable to remove from the toilet bowl.

While a preferred embodiment of the toilet bowl screen has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or composite material may be used instead of the plastic handle and ring described. Also, the razor wire may comprise a non-rusting composition or it may be coated to prevent rusting. And although trapping large items while cutting through waste and toilet paper with razor wire has been described, it should be appreciated that the toilet bowl screen herein described is also suitable for screening material in sinks and urinals and in conduction with other drains. Furthermore, a wide variety of sizes and shapes may be used instead of that described in order to adapt to different designs of toilets, sinks, and urinals.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet bowl screen, comprising:

a razor wire screen, wherein said razor wire screen comprises a plurality of wires and a plurality of cutting ribbons having opposing edges wrapped around said wires, wherein said edges are xyresic;

a ring connected to the perimeter of the razor wire screen; and a handle connected to the ring.

2. The toilet bowl screen of claim 1, wherein the toilet bowl screen traps large items while cutting through waste and toilet paper debris.

3. The toilet bowl screen of claim 1, wherein the top part of the handle is configured to rest on the rear upper surface of the toilet bowl, thereby allowing quick and easy removal of the toilet bowl screen.

4. The toilet bowl screen of claim 1, wherein the ring comprises a circular shape that is sized to fit the outlet of a toilet bowl.

5. The toilet bowl screen of claim 1, wherein the ring and handle comprise a plastic material.

6. The toilet bowl screen of claim 1, wherein the ring and handle comprise molded poly(vinyl chloride) (PVC).

7. The toilet bowl screen of claim 1, wherein the cutting ribbons comprise stainless steel.

8. The toilet bowl screen of claim 1, wherein the cutting ribbons comprise a coated metal material.

9. A toilet bowl screen, comprising:

a razor wire screen, wherein said razor wire screen comprises a plurality of wires and a plurality of cutting ribbons having opposing edges wrapped around said wires, wherein said edges are xyresic;

a circular ring connected to the perimeter of the razor wire screens wherein said ring is sized to fit the outlet of a toilet bowl; and a handle connected to the ring.

10. The toilet bowl screen of claim 9, wherein the toilet bowl screen traps large items while cutting through waste and toilet paper debris.

11. The toilet bowl screen of claim 9, wherein the top part of the handle is configured to rest on the rear upper surface of the toilet bowl, thereby allowing quick and easy removal of the toilet bowl screen.

12. The toilet bowl screen of claim 9, wherein the ring and handle comprise a plastic material.

13. The toilet bowl screen of claim 9, wherein the cutting ribbons comprise stainless steel.

14. The toilet bowl screen of claim 9, wherein the cutting ribbons comprise a coated metal material.

15. A toilet bowl screen for trapping large items while cutting through waste and toilet paper, comprising:

a razor wire screen, wherein said razor wire screen comprises a plurality of wires and a plurality of cutting ribbons having opposing edges wrapped around said wires, wherein said edges are xyresic;

a circular plastic ring connected to the perimeter of the razor wire screen, wherein said ring is sized to fit the outlet of a toilet bowl; and a plastic handle connected to the plastic ring;

wherein the top part of the handle is configured to rest on the rear upper surface of the toilet bowl, thereby allowing quick and easy removal of the toilet bowl screen.

16. The toilet bowl screen of claim 15, wherein the plastic ring and plastic handle comprise an injection molded plastic material.

17. The toilet bowl screen of claim 15, wherein the plastic ring and plastic handle comprise at least one of poly(vinyl chloride) (PVC), polystyrene (PS), polypropylene (PP), polyethylene (PE), acrylonitrile-butadiene-styrene (ABS) resin, styrene-acrylonitrile (SAN) resin, polycarbonate (PC), polyethylene terephthalate (PET), and polybutylene terephthalate (PBT).

18. The toilet bowl screen of claim 15, wherein the plastic ring and plastic handle comprise molded poly(vinyl chloride) (PVC).

19. The toilet bowl screen of claim 15, wherein the cutting ribbons comprise stainless steel.

20. The toilet bowl screen of claim 15, wherein the cutting ribbons comprise a coated metal material.

* * * * *